US006436480B1

(12) United States Patent
Upadhya

(10) Patent No.: US 6,436,480 B1
(45) **Date of Patent: *Aug. 20, 2002**

(54) THERMAL SPRAY FORMING OF A COMPOSITE MATERIAL HAVING A PARTICLE-REINFORCED MATRIX

(75) Inventor: Kamleshwar Upadhya, Zuartz Hill, CA (US)

(73) Assignee: Plasma Technology, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/607,132

(22) Filed: Jun. 29, 2000

Related U.S. Application Data

(63) Continuation-in-part of application No. 09/260,395, filed on Mar. 1, 1999, now Pat. No. 6,106,903.

(51) Int. Cl.[7] ..... C23C 4/10

(52) U.S. Cl. ..... 427/450; 427/452; 264/80; 264/455

(58) Field of Search ..... 427/450, 452; 264/80, 455

(56) References Cited

U.S. PATENT DOCUMENTS 5,372,845 A * 12/1994 Rangaswamy et al. ..... 427/216
5,454,999 A 10/1995 Jayashankar et al. ..... 419/32
5,472,487 A * 12/1995 Chin et al. ..... 427/450
5,564,620 A * 10/1996 Rawers et al. ..... 228/265
6,106,903 A * 8/2000 Upadhya ..... 427/450
6,110,853 A * 8/2000 Berger et al. ..... 501/97.4

OTHER PUBLICATIONS

"Metals Handbook, Ninth Edition", American Society for Metals, vol. 5, pp. 363–365 and 374 (1982). (No month date).*

J. Wolfenstine et al., Elevated–temperature mechanical behavior of plasma–sprayed $MoSi_2$–SiC, *Materials Science and Engineering*, vol. A189, pp. 257–266 (1994) (No month date).

A.O. Kundrath et al., "Synthesis and application of composite TiC–$Cr_3C_2$ targets,"*Surface and Coatings Technology*, vol. 94–95, pp. 237–241 (1997). (No month date).

"Metals Handbook, Ninth Edition", *American Society for Metals*, vol. 5, pp. 363–365 and 374 (1982) (No month date).

* cited by examiner

*Primary Examiner*—Katherine A. Bareford
(74) *Attorney, Agent, or Firm*—Gregory Garmong

(57) ABSTRACT

To prepare a thermally sprayed composite material, a precomposited powder is first prepared and then thermally sprayed at an ambient pressure of no less than about 0.75 atmosphere in an oxidation-preventing atmosphere. The precomposited powder has a plurality of powder particles, and each powder particle is formed of a matrix and reinforcing particles distributed within and encapsulated by the matrix. The matrix has a composition of a matrix metal such as molybdenum, hafnium, zirconium titanium, vanadium, niobium, tantalum, or tungsten, and a matrix non-metal of silicon, boron, or carbon. The reinforcement particle is silicon carbide, boron carbide, silicon nitride, or boron nitride.

20 Claims, 4 Drawing Sheets

THERMAL SPRAY FORMING OF A COMPOSITE MATERIAL HAVING A PARTICLE-REINFORCED MATRIX

This application is a continuation-in-part of allowed application Ser. No. 09/260,395, filed Mar. 1, 1999, now U.S. Pat. No. 6,106,903, for which priority is claimed and whose disclosure is incorporated by reference.

This invention relates to the fabrication of composite materials, and, more particularly, to the fabrication of a particle-reinforced composite material by thermal spray processing.

BACKGROUND OF THE INVENTION

A number of metal silicides, boride, and carbides have great potential as coatings or freestanding structural materials for use in elevated-temperature applications. However, these materials typically exhibit a low fracture toughness at room temperature, low thermal shock resistance, and low creep resistance at elevated temperatures of greater than about 1100° C. These mechanical properties inhibit the utilization of the materials in otherwise attractive applications.

As discussed in the parent application Ser. No. 09/260,395, now U.S. Pat. No. 6,106,903, the mechanical properties of one of the members of this group, molybdenum disilicide, may be significantly improved by forming a composite material of particles of silicon carbide dispersed throughout the molybdenum disilicide. Such composite materials prepared by powder compaction and sintering techniques have exhibited improved room temperature toughness and elevated temperature strength. The presence of the silicon carbide also reduces the coefficient of thermal expansion of the composite material as compared with monolithic molybdenum disilicide. Powder techniques, however, are not practical for many applications, such as certain types of coatings and large freestanding structures.

Other fabrication techniques for composites of molybdenum disilicide and silicon carbide have been proposed. For example, U.S. Pat. No. 5,472,487 discloses the loose mixing of molybdenum disilicide and any of several other types of powders, silicon carbide being one of the disclosed other powders. This loose mixture of separated particles is applied by low pressure plasma spraying of the loose mixture. The present inventor has recognized that this disclosed approach may be well suited for the fabrication of some types of composite materials, but is of limited value in preparing a composite material containing silicon carbide, because of the elevated-temperature sublimation of silicon carbide from the solid state to the gaseous state during the low pressure plasma spraying. The sublimation of the silicon carbide results in its loss from the mixture, so that the amount of silicon carbide in the final product is substantially lower than in the starting material.

The parent application provided a solution to the problems associated with using the metal borides, silicides, and carbides in the specific case of molybdenum disilicide. There is a need to extend this solution to the more general case. The present invention fulfills this need, and further provides related advantages.

SUMMARY OF THE INVENTION

The present invention provides a method for preparing a particle-reinforced composite material. A wide range of volume fractions of reinforcement particles in the composite material may be prepared. Little if any of the reinforcement material is lost in the deposition procedure, so that the final product has about the same volume fraction of reinforcement material as the starting material. The composite material is substantially fully dense, with few if any voids therein. The approach of the invention may be utilized to fabricate both coatings and freestanding structures. Large articles may be prepared relatively inexpensively, without the need for large containment chambers and the like.

In accordance with the invention, a method for preparing a mass of a thermally sprayed composite material comprises the steps of providing a precomposited powder comprising a plurality of powder particles, and thereafter thermal spray depositing the precomposited powder at an ambient pressure of no less than about 0.75 atmosphere in an oxidation-preventing atmosphere, to form a thermal sprayed mass. Each powder particle comprises a matrix having a matrix composition comprising at least one matrix chemical combination of a matrix metal and a matrix non-metal selected from the group consisting of silicon, boron, and carbon, and mixtures thereof. Each powder particle further comprises a plurality of reinforcing particles, the reinforcing particles being distributed within and encapsulated by the relatively larger matrix and having a reinforcement-particle composition selected from the group consisting of silicon carbide, boron carbide, silicon nitride, and boron nitride.

The matrix metal is preferably selected from the group consisting of hafnium, zirconium titanium, vanadium, niobium, tantalum, and tungsten, and mixtures thereof. The preferred matrices prepared by this approach include silicides such as hafnium silicide, zirconium silicide, titanium silicide, vanadium silicide, niobium silicide, tantalum silicide, and tungsten silicide; borides such as hafnium boride, zirconium boride, titanium boride, vanadium boride, niobium boride, tantalum boride, and tungsten boride; and carbides such as hafnium carbide, zirconium carbide, titanium carbide, vanadium carbide, niobium carbide, tantalum carbide, and tungsten carbide.

The thermal sprayed mass typically comprises from about 5 volume percent to about 60 volume percent, more preferably from about 10 volume percent to about 50 volume percent, of the reinforcing particles, balance the matrix (plus any other constituents present).

The precomposited powder preferably comprises relatively finer reinforcement particles, preferably having a particle size of from about 0.1 micrometer to about 1 micrometer, distributed within and encapsulated by relatively coarser powder particles of the matrix composition, preferably having a particle size of from about 5 to about 80 micrometers. Such precomposited powder may be prepared using high temperature self-sustaining combustion synthesis or any other operable technique.

The thermal spraying is preferably accomplished by plasma spraying, most preferably argon-shrouded plasma spray deposition at 1 atmosphere ambient pressure. The thermal spraying may instead be accomplished in an environmental chamber with a protective atmosphere of argon or other oxidation-preventing gas. The argon-shrouded plasma spray approach is preferred because large areas or parts may be prepared without the expense of a correspondingly sized environmental chamber. The thermal spraying is typically accomplished by depositing the thermally sprayed precomposited powder onto a substrate, such as a surface to be coated or a form for a freestanding article. The thermal spray approach is relatively economical for fabricating large areas or structures.

After thermal spraying, the thermal sprayed mass may optionally be heat treated to stress relieve internal stresses within the mass. Such internal stresses, where present and not relieved, may promote the premature failure of the thermal sprayed mass during thermal excursions or in other circumstances. The heat treatment is typically accomplished at a temperature of from about 800° C. to about 1400° C.

The present processing approach is carefully selected in order to fabricate the desired composite thermal sprayed mass. The precomposited powder must be used. The powder cannot be thermally sprayed as a loose mixture with separated particles of the matrix material and the reinforcement particles, as suggested by the '487 patent, because the reinforcement particles may sublime or otherwise degrade at elevated temperature. In that case where separated powders are used, a portion of the reinforcement may be lost as a vapor, and cannot be properly plasma sprayed because it is never present as a liquid phase that may bond with the matrix material. In the precomposited powder used in the present invention, the smaller, volatile reinforcement particles, and/or nitrides susceptible to decomposition such as silicon nitride, are encapsulated within the larger powder particles of the matrix phase, so that the liquification required for the successful thermal spraying is accomplished by the matrix material.

Further, the precomposited powder is applied by thermal spraying at about 0.75 atmosphere or greater ambient pressure, preferably at from about 0.75 atmosphere to about 1.25 atmospheres ambient pressure, and most preferably at 1 atmosphere ambient pressure. Spray fabrication of separated silicon carbide powder at greatly reduced pressures, as in the low-pressure plasma spray process used in the '487 patent, results in sublimation and at least partial evaporative loss of the silicon carbide. The combination of the use of precomposited powder and a spray process operating at about 0.75 atmospheres or greater pressure results in very little loss of the silicon carbide during application. Typically, the thermal sprayed mass has a volume percent of reinforcement particles that is no greater than 5 percentage points less than a volume percent of the reinforcement particles in the precomposited powder. For example, if the precomposited powder has about 45 volume percent of silicon carbide, the thermal sprayed mass would also have about 45 volume percent of silicon carbide, and in any event typically not less than about 40 volume percent of silicon carbide.

The avoidance of substantial loss of a volatile constituent during the thermal spraying operation is an important advantage of the present invention. Thermal sprayed composite masses with relatively large volume fractions of silicon carbide may be readily prepared. In reduced-pressure thermal spray processes using separated powders, by contrast, the maximum amount of a volatile constituent such as silicon carbide that may be incorporated in the final product is usually limited to less than about 10 volume percent due to the evaporation. Additionally, with the present approach it is not necessary to clean up substantial amounts of sublimed and evaporated silicon carbide from chamber walls, pumps, and the like as in the case of reduced-pressure spray processes.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
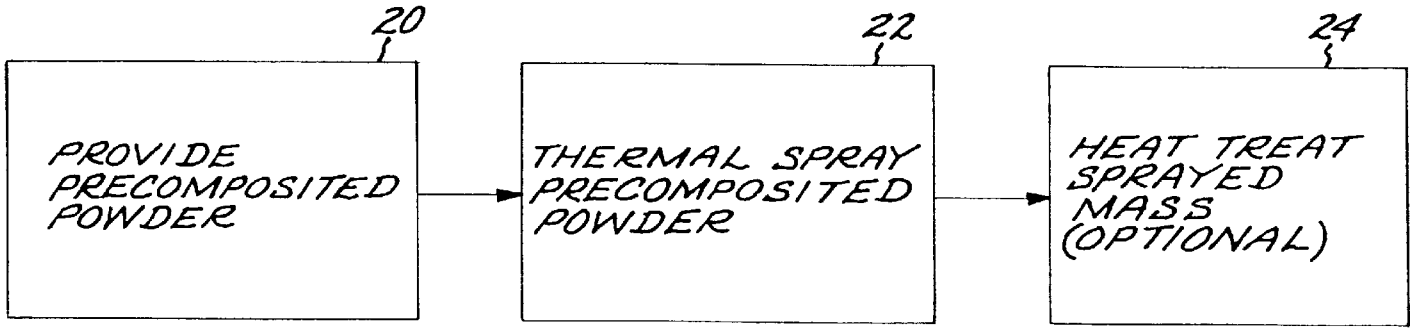
FIG. 1 is a block flow diagram of a preferred approach for practicing the present invention.
Figure 2:
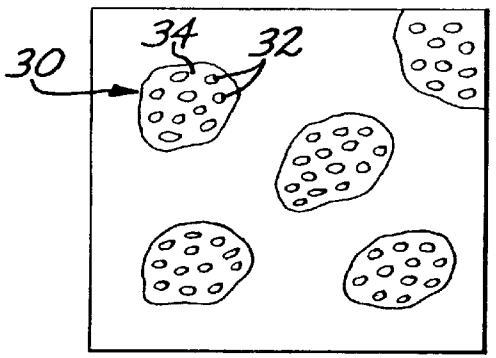
FIG. 2 is an idealized depiction of the microstructure of a precomposited powder of matrix particles and reinforcement particles.

FIG. 1 depicts a preferred approach for preparing a mass of composite material according to the invention. A precomposited powder of powder particles of a matrix composition with reinforcement particles embedded therein is provided, numeral 20. FIG. 2, which is not drawn to scale, illustrates several particles of such a precomposited powder 30. Finer particles of the reinforcement material 32 are embedded within, distributed generally uniformly within, and encapsulated within a matrix of coarser powder particles 34. ("Finer" and "coarser" are used herein relative to each other, the finer particles being smaller than the coarser particles.) The powder particles 34 are preferably generally, but not necessarily exactly, equiaxed and nearly spherical. The reinforcement particles 32 are smaller than the powder particles 34, preferably much smaller. In a preferred form of the invention, the reinforcement particles 32 have a particle size of from about 0.1 micrometer to about 1.0 micrometer (micron), more preferably from about 0.1 micrometer to about 0.5 micrometer, and the powder particles 34 a particle size of from about 5 micrometer to about 80 micrometers. Most preferably, the reinforcement particles 32 have a particle size of from about 0.1 micrometer to about 0.2 micrometers, and the powder particles 34 have a particle size of from about 70 micrometers to about 80 micrometers. That is, the reinforcement particles 32 preferably have sizes less than one percent of the sizes of the powder particles 34 in which they are embedded and encapsulated. The reinforcement particles 32 are present in any operable volume fraction, but preferably in an amount of from about 5 volume percent to about 60 volume percent, more preferably from about 10 volume percent to about 50 volume percent, of the total volume of the precomposited powder 30. An important feature of the present approach is that the reinforcement material of the reinforcement particles 32 is encapsulated within the powder particles 34, so that the reinforcement material cannot sublime and evaporate, or be oxidized or otherwise altered, during thermal spraying, and so that the matrix composition of the powder particles 34 melts during thermal spraying to permit consolidation upon impingement upon a substrate.

The reinforcement particles 32 are silicon carbide, boron carbide, silicon nitride, boron nitride, or mixtures thereof. ("Mixtures thereof" means in this context that any two or more of the listed types of particles may be mixed together.) These materials are selected because they are highly corrosion resistant and have high hardness. Their presence generally increases the toughness of the matrix materials which tend to be somewhat brittle and sometimes exhibit ductile-to-brittle transitions in lower temperature ranges.

The matrix in which the reinforcement particles 32 are embedded, which matrix material forms the balance of the powder particles 34, has a matrix composition comprising at least one matrix chemical combination of a matrix metal, and a matrix non-metal selected from the group consisting of silicon, boron, and carbon, and mixtures thereof. The matrix metal is preferably selected from the group consisting of molybdenum, hafnium, zirconium, titanium, vanadium, niobium, tantalum, and tungsten, and mixtures thereof. Thus, in the three main embodiments of the matrix material, the matrix material is selected from the group consisting of molybdenum silicide, hafnium silicide, zirconium silicide, titanium silicide, vanadium silicide, niobium silicide, tantalum silicide, and tungsten silicide; selected from the group consisting of hafnium boride, zirconium boride, titanium boride, vanadium boride, niobium boride, tantalum boride, and tungsten boride; or selected from the group consisting of molybdenum carbide, hafnium carbide, zirconium carbide, titanium carbide, vanadium carbide, niobium carbide, tantalum carbide, and tungsten carbide. (As used herein, the generic term encompasses available chemical variations. For example, "molybdenum silicide" includes, but is not limited to, molybdenum disilicide.) Mixtures may be formed from within or between these various groups. For example, some of the powder particles 34 may have a hafnium boride ($HfB_2$) matrix with boron carbide reinforcement particles, and some of the powder particles may have a molybdenum silicide matrix with silicon carbide reinforcement particles.

The precomposited powder is made by any operable approach. Preferably, it is prepared by high temperature self-sustaining combustion synthesis, a known process which is described, for example, in U.S. Pat. Nos. 4,402,776 and 5,564,620, and in A. O. Kunrath et al., "Synthesis and application of composite TiC—$Cr_3C_2$ targets", *Surface and Coatings Technology*, vol. 94–95 (1997), pages 237–241.

Figure 3:
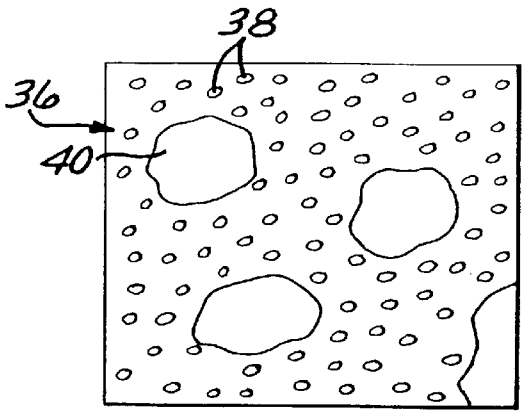
FIG. 3 is an idealized depiction of the structure of a loose mixture of matrix-material particles and reinforcement particles that is not operable with the present invention.

FIG. 3 illustrates a form of separated powder mixture 36 which is not operable in the invention and is not within the scope of the term "precomposited powder" as used herein. In this separated powder mixture 36, particles 38 of some potential reinforcing material 38 and particles 40 of some potential matrix material are loose and separated from each other. The particles 38 are not embedded within, distributed generally uniformly within, or encapsulated within the particles 40.

Returning to FIG. 1, the precomposited powder is thermal sprayed, numeral 22, to form a thermal sprayed mass. Any operable thermal spray approach may be used, as long as it is conducted at an ambient pressure of no less than about 0.75 atmosphere (1 atmosphere is approximately 14.7 pounds per square inch) and in an oxidation-preventing, nonreactive atmosphere to prevent oxidation of the thermally sprayed material and the substrate being sprayed. The "ambient" pressure is that externally surrounding the powder as it is thermally sprayed.

Figure 4:
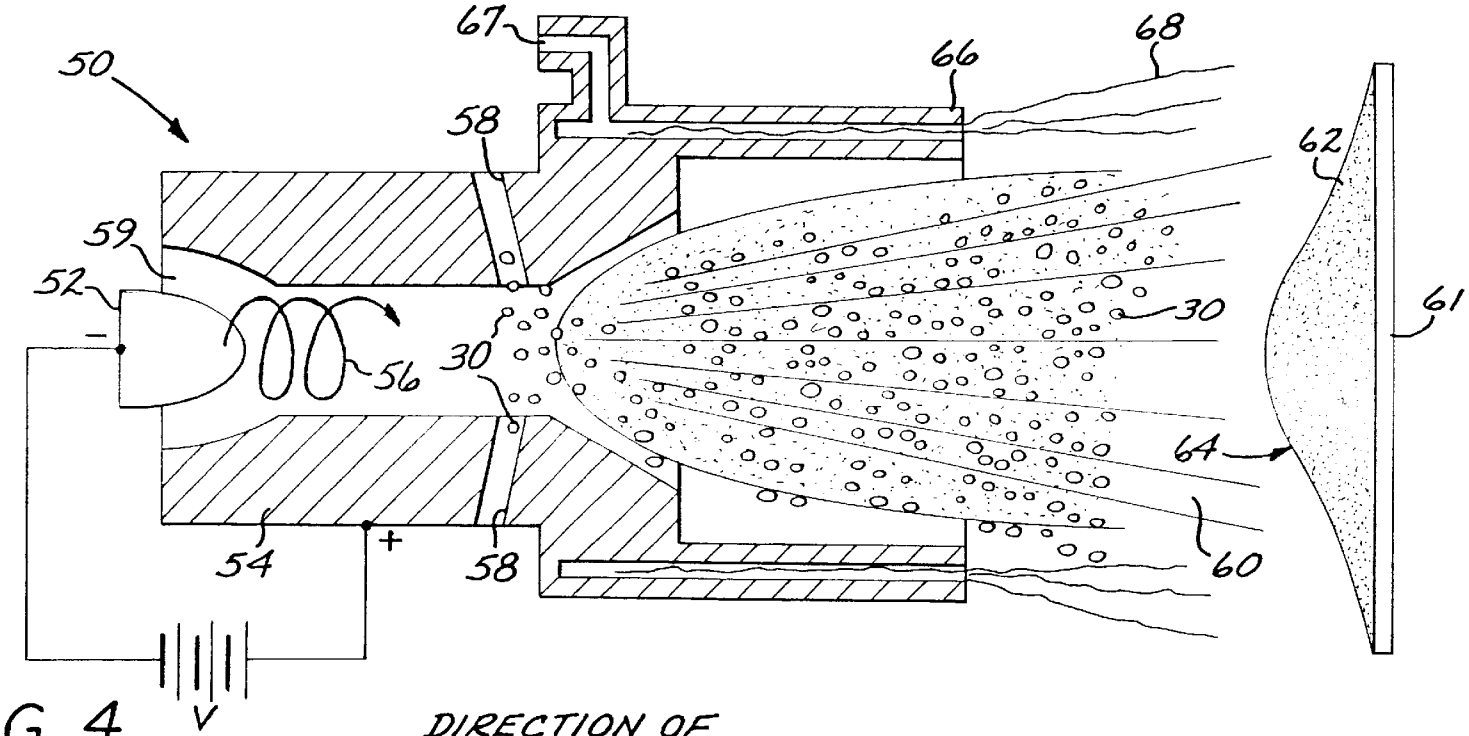
FIG. 4 is a schematic view of a preferred apparatus for practicing the invention using a gas-shrouded plasma spray deposition torch.

A preferred thermal spray apparatus is illustrated in FIG. 4. An argon-shrouded plasma spray deposition apparatus 50 includes a central electrode 52 that is electrically negatively biased with respect to a concentric tubular body 54 of the apparatus 50. Electrons 56 are emitted from the central electrode 52 into the interior of the tubular body 54. Precomposited powder 30, as described above, and optionally an inert, non-oxidizing, fluidizing gas such as argon, are supplied through an input tube 58 and flowed through the tubular body 54. Additional inert, non-oxidizing gas, preferably argon, may optionally be flowed through the tubular body 54 through an argon input 59. In operation, an electrical arc 60 is struck between the apparatus 50 and a target substrate 61, forming a plasma. At least a portion of the matrix material of the powder particles 34 at the surface of the precomposited powder 30 is melted as the precomposited powder 30 flows through the electrical arc 60 and associated plasma and toward the substrate 61. Upon striking the substrate 61, or previously deposited material 62 overlying the substrate 61, the melted portion of the precomposited powder 30 solidifies to form a thermal sprayed mass 64. The reinforcement powder encapsulated within the matrix material of the powder particles 34 need not melt to a liquid phase, as is required in conventional plasma spray deposition. The reinforcement particles 32 cannot be evaporatively lost, because they are encapsulated within the powder particles 34.

A concentric shroud tube 66 surrounds and overlies the powder tube 56. A nonreactive gas that prevents oxidation, such as an inert gas and most preferably argon, is flowed through an argon input 67 and thence through the shroud tube 66, and exits to form a gas shroud 68 surrounding the electrical arc 60 and plasma, and the partially melted precomposited powder 30 therein. The gas shroud 68 also extends over the most recently deposited thermal sprayed mass 64. The gas shroud 68 prevents oxidation of the partially melted precomposited powder 30 and the most recently deposited thermal sprayed mass 64, allowing it to cool to a sufficiently low temperature that oxidation is no longer a concern. (Other nonreactive gases such as helium or nitrogen may be used.)

The plasma spray deposition apparatus 50 is operated in the ambient atmosphere without any vacuum chamber or environmental control chamber, most preferably at one atmosphere ambient pressure. It therefore may be moved freely about, to be used to form either relatively thin coatings on the substrate or relatively thick layers that are freestanding, regardless of the size of the substrate. One significant limitation of many other spray deposition procedures is that they must be operated in vacuum chambers or other types of environmental control chambers, effectively limiting the size and configuration of the substrate unless very large and expensive chambers are available. The present apparatus may also be used for on-site repairs, which is often not possible for those techniques requiring environmental control chambers.

Figure 5:
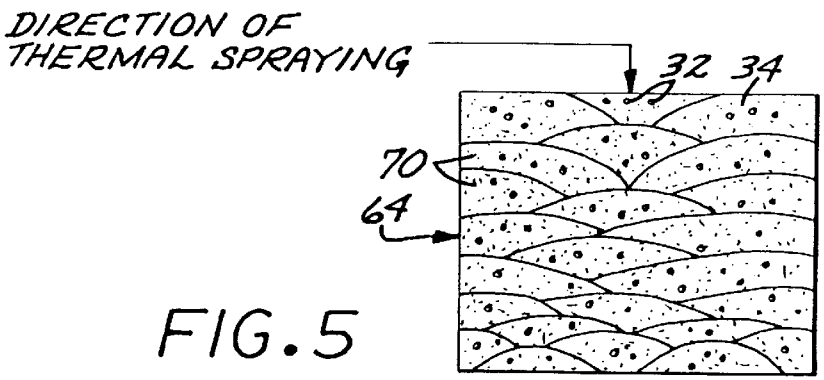
FIG. 5 is an idealized depiction of a thermal sprayed mass prepared by the approach of the invention.

FIG. 5 illustrates the resulting structure of the thermal sprayed mass 64. The thermal sprayed mass 64 is formed of the resolidified particles 70 of precomposited powder 30, which have been partially melted on their outer surfaces, forced together at impact upon their target, and resolidified in a dense, mass having few, if any, voids or pores therein. The thermal sprayed mass 64 is formed of the reinforcement particles 32 distributed generally uniformly within the reshaped powder particles 34. The resolidified particles 70 are typically flattened in the direction perpendicular to the direction of thermal spray deposition onto the substrate 61 (from the top toward the bottom in FIG. 5). An important feature of the invention is that during the thermal spray deposition the reinforcement particles 32 are never exposed to vacuum or to the ambient environment, because they are encapsulated within the matrix material of the powder particles 34. Consequently, very little, if any, reinforcement material of the reinforcement particles 32 is lost to sublimation and/or evaporation, or is chemically changed as by oxidation or other reaction, so that the volume fraction of reinforcement material in the solidified thermal sprayed mass 64 is the same or substantially the same as that in the starting material, the precomposited powder 30. At most, there would be reduction in volume fraction of the reinforcement material of the powder particles 32 of 5 percentage points from the precomposited powder 30 to the thermal sprayed mass 64, but in practice that figure is much nearer to zero loss of reinforcement material.

Figure 6:
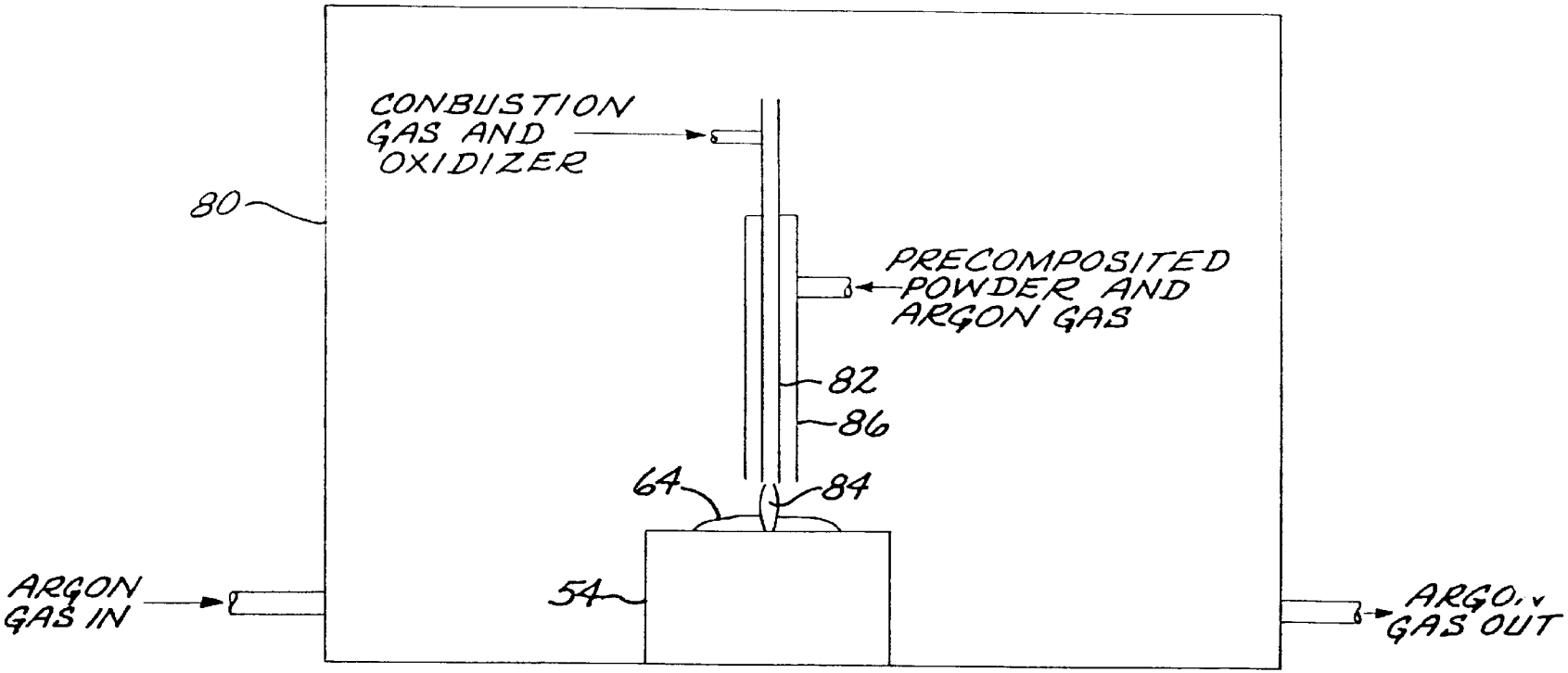
FIG. 6 is a schematic view of the apparatus of a second embodiment of the invention.

An important feature of the preferred embodiment is that it requires no environmental control chamber. In some cases, providing a controlled environment may not be difficult, and the present invention may be used in conjunction with an environmental control chamber. In the second embodiment illustrated in FIG. 6, an environmental control chamber 80 is used to produce a protective environment at an ambient pressure of about 0.75 atmospheres or greater. In the illustrated case, argon or other non-oxidizing, non-reactive gas flows through the environmental control chamber to establish the protective atmosphere. The thermal spray may be produced with an electrical arc, as in the plasma spray deposition apparatus 50, but an alternative approach is illustrated in FIG. 6. Here, a combustion gas and oxidizer (for example, hydrogen and oxygen) are supplied and flowed through a central tube 82. The combustion gas and oxidizer are ignited to form a plasma 84. Precomposited powder and argon gas are flowed through an outer tube 86 and into the plasma. The outer surface of the precomposited powder 30 is partially melted in the plasma and deposited upon the substrate 61 as the thermal sprayed mass 64, as described previously. No shroud gas is required, inasmuch as the entire interior of the environmental control chamber is filled with the non-oxidizing, non-reactive gas. Other techniques for forming the plasma, such as laser energy, may be used.

Returning to FIG. 1, the as-deposited thermal sprayed mass may optionally be heat treated, numeral 24. The heat treatment is performed to relieve internal stresses in the thermal sprayed mass. A preferred heat treatment is to heat the thermal sprayed mass 64 to a temperature of from about 800° C. to about 1400° C., more preferably from about 800° C. to about 1000° C., for a time of from about 30 minutes to about 5 hours, in an inert gas such as argon. The heat treatment also allows the crystal structure of the matrix material to be established uniformly as a more nearly equiaxed crystalline phase with the flattened grains illustrated in FIG. 5.

Figure 7:
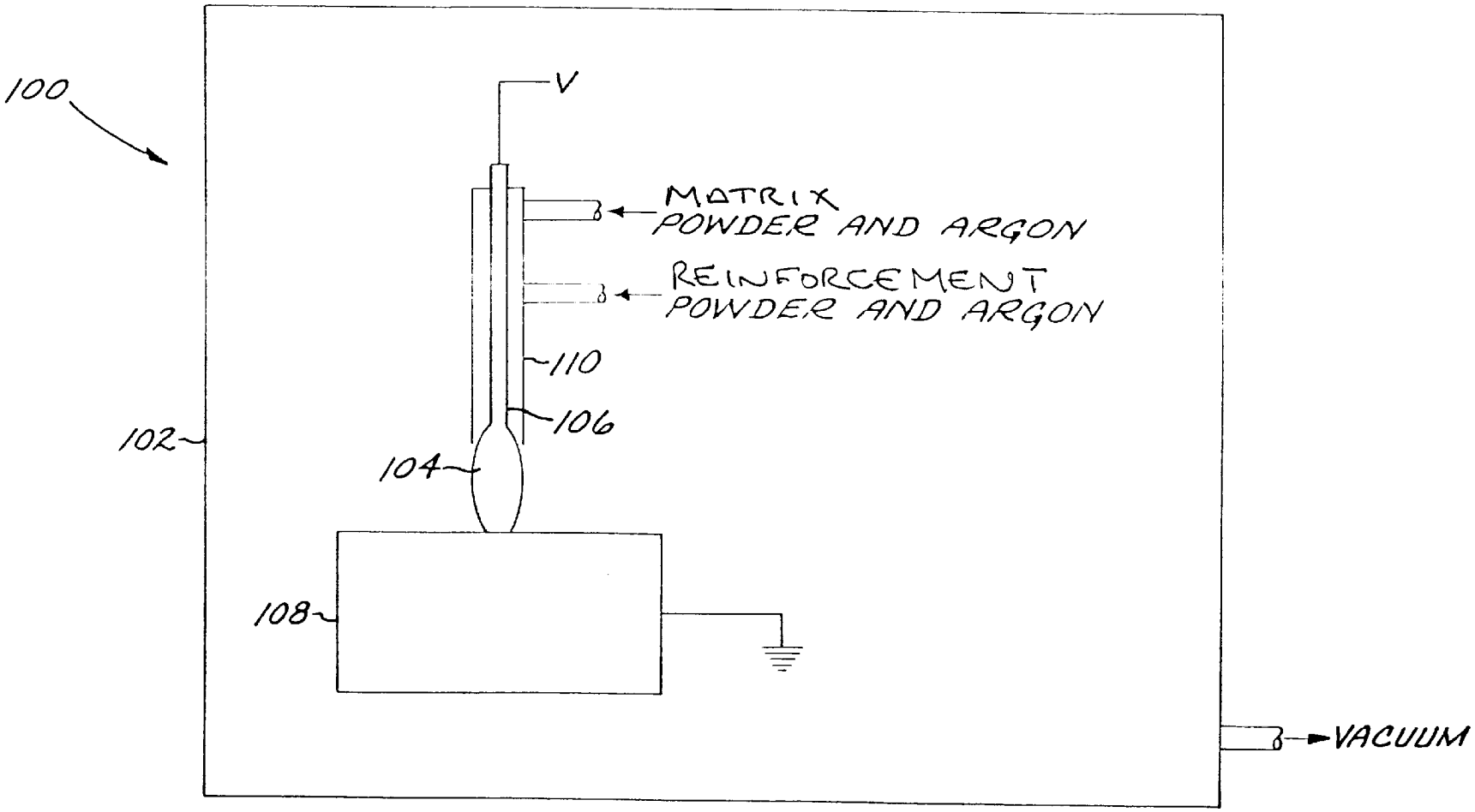
FIG. 7 is a schematic view of an apparatus which is not in accordance with the invention.

FIG. 7 illustrates an approach which is not within the scope of the present invention. In this deposition apparatus 100, a chamber 102 is evacuated to a sub-atmospheric pressure below about 0.75 atmosphere, typically about 0.25 atmosphere or less. A plasma 104 is formed between an electrode 106 and a substrate 108. The plasma may be formed by combustion or other approach as well. The matrix material and the reinforcement particles, both fluidized in a gas such as argon, are furnished in a loose, separated form, as was illustrated in FIG. 3. That is, the matrix material and the reinforcement particles are not precomposited. The matrix material and the reinforcement particles are flowed into a powder tube 110, where they mix and flow into the plasma 104, where the matrix material at least partially melts. The reinforcement material, however, typically does not melt, but instead sublimes, evaporates, or chemically reacts, at least in part. There is a large loss of the reinforcement material to evaporation, which evaporated material coats the interior of the chamber 102 or is drawn into the vacuum system where it must be cleaned out. The volume fraction of reinforcement in the final deposit is substantially less than the associated ratio in the starting powders. It may be expected that the volume fraction of reinforcement material may be limited to no more than about 10 volume percent in some cases due to sublimation, which may be too low for many applications. In one case using this approach that is not within the scope of the present invention, it was reported that the silicon carbide was 20 volume percent of the total of the starting feed mass of molybdenum disilicide and silicon carbide, but was present in an amount of only 9 percent of the deposit on the substrate.

The present invention has been reduced to practice with the argon-shrouded plasma spray apparatus of FIG. 4. Coatings were produced on a silicon carbide foam substrate in thicknesses of 0.012, 0.016, 0.017, 0.018, 0.022, and 0.030 inches. Final thermal sprayed masses were produced with nominal silicon carbide contents of 25, 35, and 45 volume percent. (Molybdenum disilicide coatings with no silicon carbide present were produced as controls.) The specimen with a nominal silicon carbide content of 45 volume percent had 45 volume percent of silicon carbide in the precomposited powder 30 feed material. This specimen was measured by image microanalysis techniques to have between 44 and 46 volume percent of silicon carbide in the deposited thermal sprayed mass. That is, within the experimental error of the measurements, no silicon carbide was lost from the precomposited powder during the argon shrouded plasma deposition.

Various of the specimens were tested to determine relevant mechanical and physical properties. Molybdenum disilicide with 25 volume percent of silicon carbide in a thickness of 0.017 inches, molybdenum disilicide with 25 volume percent of silicon carbide in a thickness of 0.018 inches, molybdenum disilicide with 25 volume percent of silicon carbide in a thickness of 0.025 inches, molybdenum disilicide with 45 volume percent of silicon carbide in a thickness of 0.018 inches, and molybdenum disilicide with 45 volume percent of silicon carbide in a thickness of 0.025 inches exhibited no cracking or spallation when heated to 1500° C. in an inert atmosphere, to evaluate mechanical properties. The molybdenum disilicide coatings with no silicon carbide present exhibited cracking and spallation in this same test.

In an oxidation test, molybdenum disilicide with 25 volume percent of silicon carbide in a thickness of 0.016 inches thick and molybdenum disilicide with 45 volume percent of silicon carbide in a thickness of 0.025 inches were heated in air with an oxyacetylene torch to 1600–1700° C. The specimens exhibited no oxidation damage. Specimens of the other coatings were tested to 1500–1600° C. in a similar manner, and showed no oxidation damage.

In another reduction to practice, a coating was prepared with about 55 percent by volume of silicon carbide particles in a matrix of hafnium boride.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing a mass of a thermally sprayed composite material, comprising the steps of providing a precomposited powder comprising a plurality of powder particles, each powder particle consisting of a matrix having a matrix composition comprising at least one matrix chemical combination of a matrix metal, and a matrix non-metal selected from the group consisting of silicon, boron, and carbon, and mixtures thereof, and a plurality of reinforcing particles, the reinforcing particles being distributed within and encapsulated by the relatively larger matrix and having a reinforcement-particle composition selected from the group consisting of silicon carbide, boron carbide, boron nitride, and mixtures thereof; and thereafter thermal spray depositing the precomposited powder at an ambient pressure of no less than about 0.75 atmosphere in an oxidation-preventing atmosphere, to form a thermal sprayed mass.

2. The method of claim 1, wherein the precomposited powder comprises the reinforcing particles having a reinforcing-particle size of from about 0.1 micrometer to about 1.0 micrometer, distributed within the powder particles having a particle size of from about 5 micrometers to about 80 micrometers.

3. The method of claim 1, wherein the step of providing a mixture includes the step of preparing the precomposited powder using high temperature self-sustaining combustion synthesis.

4. The method of claim 1, wherein the oxidation-preventing atmosphere is an argon atmosphere.

5. The method of claim 1, wherein the step of thermal spray depositing includes the step of thermal spray depositing the precomposited powder by argon-shrouded plasma spray deposition.

6. The method of claim 1, wherein the step of thermal spray depositing is performed at 1 atmosphere ambient pressure.

7. The method of claim 1, wherein the step of thermal spray depositing is performed at an ambient pressure of from about 0.75 atmosphere to about 1.25 atmosphere.

8. The method of claim 1, wherein the step of thermal spray depositing is performed in an environmental chamber.

9. The method of claim 1, wherein the step of thermal spray depositing includes the step of thermal spray depositing the precomposited powder onto a substrate.

10. The method of claim 1, wherein the thermal sprayed mass is a coating.

11. The method of claim 1, wherein the thermal sprayed mass is a freestanding structure.

12. The method of claim 1, wherein the thermal sprayed mass comprises from about 5 volume percent of the reinforcing particles to about 60 volume percent of the reinforcing particles, balance matrix composition.

13. The method of claim 1, wherein the thermal sprayed mass comprises a volume percent of the reinforcing particles that is no greater than 5 percentage points less than a volume percent of the reinforcing particles in the precomposited powder.

14. A method for preparing a mass of a thermally sprayed composites material, comprising the steps of providing a precomposited power comprising a plurality of powder particles, each powder particle consisting of a matrix having a matrix composition comprising at least one matrix chemical combination of a matrix metal, and a matrix non-metal selected from the group consisting of silicon, boron, and carbon, and mixtures thereof, and a plurality of reinforcing particles, the reinforcing particles being distributed within and encapsulated by the relatively larger matrix and having a reinforcement-particle composition selected from the group consisting of silicon carbide, boron carbide, silicon nitride, boron nitride, and mixtures thereof; and thereafter thermal spray depositing the precomposited powder at an ambient pressure of no less than about 0.75 atmosphere in an oxidation-preventing atmosphere, to form a thermal sprayed mass; and thereafter heat treating the thermal sprayed mass.

15. The method of claim 14, wherein the step of heat treating includes the step of heating the thermal sprayed mass to a temperature sufficient to relieve internal stresses therein.

16. The method of claim 14, wherein the step of heat treating includes the step of heating the thermal sprayed mass to a temperature of from about 800° C. to about 1400° C.

17. A method for preparing a mass of a thermally sprayed composite material, comprising the steps of providing a precomposited powder comprising a plurality of powder particles, each powder particle having a matrix having a composition consisting of at least one matrix chemical combination of a matrix metal selected from the group consisting of molybdenum, hafnium, zirconium, titanium, vanadium, niobium, tantalum, and tungsten, and mixtures thereof, and a matrix non-metal selected from the group consisting of silicon, boron, and carbon, and mixtures thereof, and a plurality of reinforcing particles, the reinforcing particles being distributed within and encapsulated by the relatively larger matrix and having a reinforcement-particle composition selected from the group consisting of silicon carbide, boron carbide, silicon nitride, boron nitride, and mixtures thereof, the matrix forming the balance of each powder particle, the matrix forming the balance of each powder particle; and thereafter thermal spray depositing the precomposited powder at an ambient pressure of no less than about 0.75 atmosphere in an oxidation-preventing atmosphere, to form a thermal sprayed mass.

18. The method of claim 17, wherein the precomposited powder comprises a matrix composition selected from the group consisting of molybdenum silicide, hafnium silicide, zirconium silicide, titanium silicide, vanadium silicide, niobium silicide, tantalum silicide, and tungsten silicide.

19. The method of claim 17, wherein the precomposited powder comprises a matrix composition selected from the group consisting of hafnium boride, zirconium boride, titanium boride, vanadium boride, niobium boride, tantalum boride, and tungsten boride.

20. The method of claim 17, wherein the precomposited powder comprises a matrix composition selected from the group consisting of molybdenum carbide, hafnium carbide, zirconium carbide, titanium carbide, vanadium carbide, niobium carbide, tantalum carbide, and tungsten carbide.

* * * * *